US011107607B2

(12) United States Patent
Siripurapu et al.

(10) Patent No.: US 11,107,607 B2
(45) Date of Patent: Aug. 31, 2021

(54) FOAMED POLYCARBONATE SEPARATORS AND CABLES THEREOF

(71) Applicant: GENERAL CABLE TECHNOLOGIES CORPORATION, Highland Heights, KY (US)

(72) Inventors: Srinivas Siripurapu, Carmel, IN (US); Scott M. Brown, Independence, KY (US); Stephen A. Thwaites, Walton, KY (US)

(73) Assignee: General Cable Technologies Corporation, Highland Heights, KY (US)

( * ) Notice: Subject to any disclaimer, the term of this patent is extended or adjusted under 35 U.S.C. 154(b) by 219 days.

(21) Appl. No.: 14/731,955

(22) Filed: Jun. 5, 2015

(65) Prior Publication Data

US 2015/0357095 A1 Dec. 10, 2015

Related U.S. Application Data

(60) Provisional application No. 62/008,941, filed on Jun. 6, 2014.

(51) Int. Cl.

| | |
|---|---|
| ***H01B 17/00*** | (2006.01) |
| ***H01B 17/14*** | (2006.01) |
| ***H01B 7/295*** | (2006.01) |
| ***H01B 11/04*** | (2006.01) |
| *H01B 11/06* | (2006.01) |

(52) U.S. Cl.

CPC ..... *H01B 17/14* (2013.01); *H01B 7/295* (2013.01); *H01B 11/04* (2013.01); *H01B 11/06* (2013.01)

(58) Field of Classification Search

CPC ..... H01B 11/04; H01B 11/06; H01B 7/295
USPC ..... 174/113 R
See application file for complete search history.

(56) References Cited

U.S. PATENT DOCUMENTS

| | | | | |
|---|---|---|---|---|
| 3,105,872 | A | 10/1963 | Thompson et al. | |
| 3,277,029 | A * | 10/1966 | Chadwick | C08J 9/04 521/180 |
| 3,929,908 | A | 12/1975 | Orlando et al. | |
| 4,126,740 | A | 11/1978 | Factor et al. | |
| 4,170,711 | A | 10/1979 | Orlando et al. | |
| 4,923,933 | A | 5/1990 | Curry | |
| 5,010,148 | A | 4/1991 | Lewis | |

(Continued)

FOREIGN PATENT DOCUMENTS

| | | |
|---|---|---|
| EP | 0352699 A1 | 7/1989 |
| EP | 2487694 A1 | 8/2012 |

(Continued)

OTHER PUBLICATIONS

Thomas, Shane; International Search Report and Written Opinion of the International Searching Authority, issued in International Application No. PCT/US2015/034447; dated Sep. 15, 2015; 8 pages.

(Continued)

*Primary Examiner* — Pete T Lee
(74) *Attorney, Agent, or Firm* — Ulmer & Berne LLP

(57) ABSTRACT

A cable separator includes a body, and the body includes a polycarbonate-based material that is at least a partially foamed. Cables and methods of manufacturing such cables having a separator are also provided.

17 Claims, 4 Drawing Sheets

(56) References Cited

U.S. PATENT DOCUMENTS 5,317,051 A * 5/1994 Harashige ..... C08K 3/22 524/310
5,391,594 A 2/1995 Romenesko et al.
5,574,250 A * 11/1996 Hardie ..... H01B 11/005 174/102 R
5,969,295 A * 10/1999 Boucino ..... H01B 11/06 174/113 C
6,310,145 B1 10/2001 Puyenbroek et al.
6,504,379 B1 1/2003 Jackson
7,144,935 B2 12/2006 Seidel et al.
7,303,810 B2 12/2007 Goodson et al.
7,449,638 B2 * 11/2008 Clark ..... H01B 11/04 174/113 C
7,695,815 B2 4/2010 Agarwal et al.
7,732,516 B2 * 6/2010 Shen ..... C08G 73/1046 524/155
7,848,604 B2 12/2010 Reed et al.
7,858,686 B2 12/2010 Jarus et al.
8,097,809 B2 1/2012 Galletti et al.
RE43,616 E 8/2012 Chung et al.
8,445,568 B2 5/2013 Karremans et al.
8,562,873 B2 10/2013 Murakami
2004/0232598 A1 11/2004 Donea et al.
2005/0199415 A1 9/2005 Glew
2006/0115222 A1 6/2006 Park et al.
2007/0102188 A1 * 5/2007 Glew ..... H01B 7/295 174/113 C
2007/0299169 A1 * 12/2007 Ohira ..... C08J 3/226 524/100
2008/0015289 A1 1/2008 Siripurapu
2008/0033083 A1 * 2/2008 Li ..... C08F 279/02 524/115
2008/0166537 A1 7/2008 Frankowski et al.
2009/0069489 A1 * 3/2009 Vollenberg ..... C08L 67/025 524/537
2009/0306258 A1 12/2009 Siripurapu et al.
2010/0021718 A1 1/2010 Vos et al.
2010/0046894 A1 2/2010 Kachmar
2010/0280159 A1 11/2010 Maas et al.
2011/0052895 A1 3/2011 Li et al.
2011/0229704 A1 9/2011 Grcev et al.
2012/0090871 A1 * 4/2012 Kato ..... H01B 3/447 174/102 R
2012/0267142 A1 10/2012 Nordin et al.
2012/0267146 A1 10/2012 Petry et al.
2013/0000950 A1 * 1/2013 Yamada ..... B60R 16/02 174/117 F
2013/0224461 A1 8/2013 van der Mee et al.
2013/0224462 A1 8/2013 van der Mee et al.
2013/0313493 A1 11/2013 Wen et al.
2013/0330468 A1 * 12/2013 Makadia ..... C08K 5/52 427/117
2014/0011065 A1 1/2014 Kwon et al.
2014/0027150 A1 1/2014 Gundel
2014/0069687 A1 3/2014 Tryson et al.

FOREIGN PATENT DOCUMENTS

GB 1280762 A * 7/1972 ..... H01B 9/06
JP 10-168319 A 6/1998
JP 2000-143964 A 5/2000
JP 2003-36736 A 2/2003
JP 2008-198592 A 8/2008
JP 2012-144701 A 8/2012
JP 5325683 B2 7/2013
WO 2013130805 A1 9/2013
WO 2013131474 A1 9/2013
WO 2014018672 A1 1/2014

OTHER PUBLICATIONS

Vanier, Cecile; Extended European Search Report, including supplementary European search report and European search opinion, issued in European Patent Application No. 15803888.5; dated Apr. 30, 2018; 8 pages.
Vanier, Cecile; Examination Report issued in European Patent Application No. 15803888.5; dated Feb. 6, 2019; 4 pages.

* cited by examiner

FOAMED POLYCARBONATE SEPARATORS AND CABLES THEREOF

REFERENCE TO RELATED APPLICATION

The present application claims the priority of U.S. provisional application Ser. No. 62/008,941, entitled FOAMED POLYCARBONATE SEPARATORS AND CABLES THEREOF, filed Jun. 6, 2014, and hereby incorporates the same application herein by reference in its entirety.

TECHNICAL FIELD

The present disclosure generally relates to cable separators, and more particularly relates to foamed polycarbonate cable separators.

BACKGROUND

Cable separators have been used to physically separate a plurality of conductors within a cable to improve various characteristics and properties of such cables. Known cable separators, however, have suffered from a number of drawbacks including high flammability and excessive weight. Efforts to improve cable separators with flame retardant materials, however, have caused further drawbacks including the use of expensive materials and degradation of electrical properties. Consequently, there is a need for inexpensive cable separators that meet, or exceed, the physical and electrical requirements of flame retardant cable separators without suffering from the same drawbacks.

SUMMARY

In accordance with one example, a cable separator includes a body. The body includes a polycarbonate-based material. The polycarbonate-based material is at least partially foamed.

In accordance with another example, a cable separator includes a body. The body includes a polycarbonate polymer, a polycarbonate-siloxane copolymer and a metal sulfonate. The body is at least partially foamed.

In accordance with another example, a cable separator includes a body. The body includes a polycarbonate polymer, a polycarbonate-siloxane copolymer and at least one a halogenated flame retardant and an anti-drip additive. The body is at least partially foamed.

DETAILED DESCRIPTION

Figure 1:
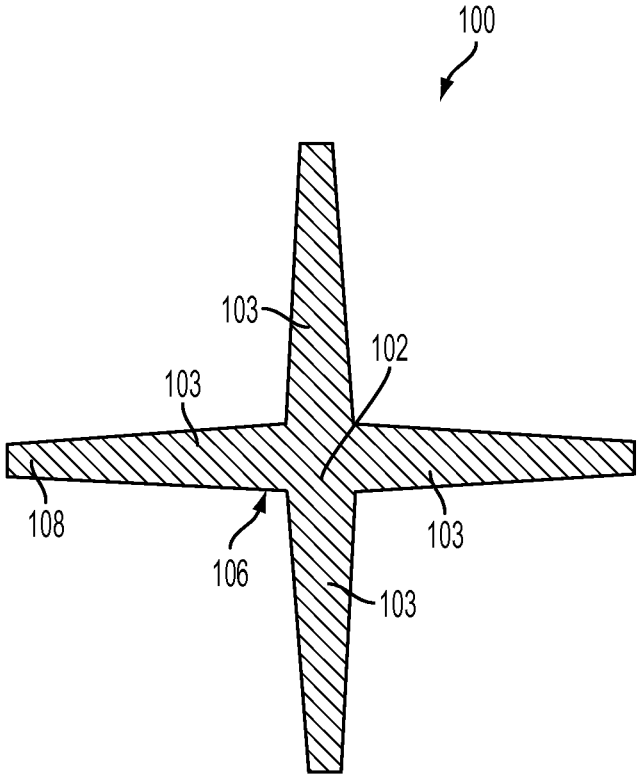
FIG. 1 depicts a cross-sectional end view of a cable separator according to one embodiment.

Referring to FIG. 1, a cable separator 100 can generally include a body 102. The body 102 can include a polycarbonate-based material. The polycarbonate-based material can also be at least partially foamed. The body 102 can have a relatively narrow cross-section, as depicted in FIG. 1, but can have an indeterminate longitudinal length to allow the cable separator 100 to be used in cables of varying lengths.

A body of a cable separator can include various features to separate, or space apart, at least one conductor in a conductive cable from other conductors in the cable. For example, in certain embodiments, the body 102 can include one, or more, projections 103 that can extend radially outward from a central portion of the body 102 to physically separate the conductors (e.g., 202 in FIG. 2). In certain embodiments, the cable separator 100 can include four such projections 103 with each projection 103 equally disposed around the central portion and perpendicular to the adjacent projection 103. However, as will be appreciated, a cable separator can alternatively include less than four projections or more than four projections, according to certain embodiments, depending on, for example, the number of conductors, and the desired cable geometry. As further shown in FIG. 1, each projection 103 can have a first end 106 located at the center of the body 102, and a second end 108 located at the terminal end of the projection 103.

According to certain embodiments, each projection of a cable separator can be tapered. For example, each projection 103 can be larger near the first end 106 and can be smaller at the second end 108 to produce a taper as depicted in FIG. 1. As can be appreciated, such projections can alternatively have a substantially similar size at a first end and at a second end to produce a uniformly flat projection (for example, see 400 in FIG. 4) or can be larger near the second end than the first end in other embodiments to produce an alternatively biased taper. In certain embodiments, each projection can also taper until a substantially single point is reached at the terminal end of each projection. As will be appreciated, such separators can be called star separators.

The configuration of a cable separator can be important to its intended functionality and performance. As such, a body of each separator can be "preshaped" according to certain embodiments. Preshaped can mean that the separator was manufactured, or extruded, in a predetermined shape that can be maintained throughout the construction and use of the cable. Such preshaped separators can be beneficial by eliminating the need for further configuration, arrangement, or manipulation of the separator during cable construction. Preshaped separators can, however, retain flexibility to allow for manipulation and temporary deformation of the separator during construction and use of the cable. In certain embodiments, a preshaped separator can prevent kinking of the cable during installation and can reduce sagging of unsupported cables.

Figure 2:
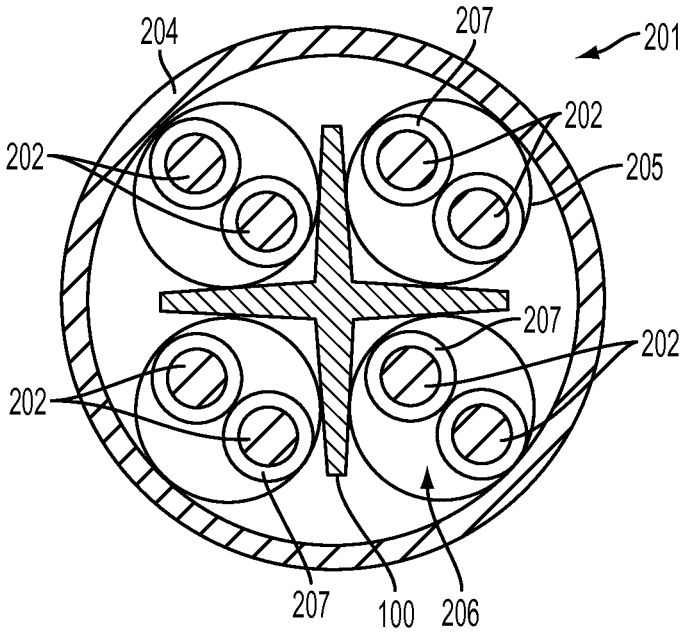
FIG. 2 depicts a cross-sectional end view of a cable incorporating the cable separator depicted in FIG. 1 according to one embodiment.

As depicted in FIG. 2, the cable separator 100 can be incorporated into a cable 201 containing a plurality of conductors 202 surrounded by an outer protective jacket 204. In certain embodiments, at least some of the plurality of conductors 202 can be further organized into twisted conductor pairs 206. Twisted conductor pairs 206 can be useful, for example, in the production of data communication cables as conductor pairs 206 can, for example, reduce undesirable crosstalk interference. In certain embodiments, the twisted conductor pairs 206 can be further shielded by a shield layer 205. As shown in FIG. 2, the cable separator 100 can separate, or space apart, each of the twisted conductor pairs 206 from the other twisted conductor pairs 206. As can be appreciated, the separator can, in certain embodiments, also, or alternatively, space apart individual conductors or other conductor groupings. As will be appreciated, individual conductors can also, in certain embodiments, by insulated. As shown in FIG. 2, each of the individual conductors 202 can have an insulation layer 207.

When used in data communication cables, a cable separator can be used to improve various electrical or physical properties necessary to achieve various certifications. For example, a cable separator can in certain embodiments, be used to help certify a data communication cable as a Category 5, Category 5e, Category 6, Category 6A, Category 7, or higher standard under TIA/EIA qualifications. Further details of data communication cables are described in U.S. Patent Application Publication No. 2012/0267142 which is hereby incorporated by reference.

In certain embodiments, a cable separator can also be used in cables with non-conductive elements. For example, a cable separator can be used in the construction of a fiber optic data cable and, in such embodiments, can separate the optical fibers.

Figure 3:
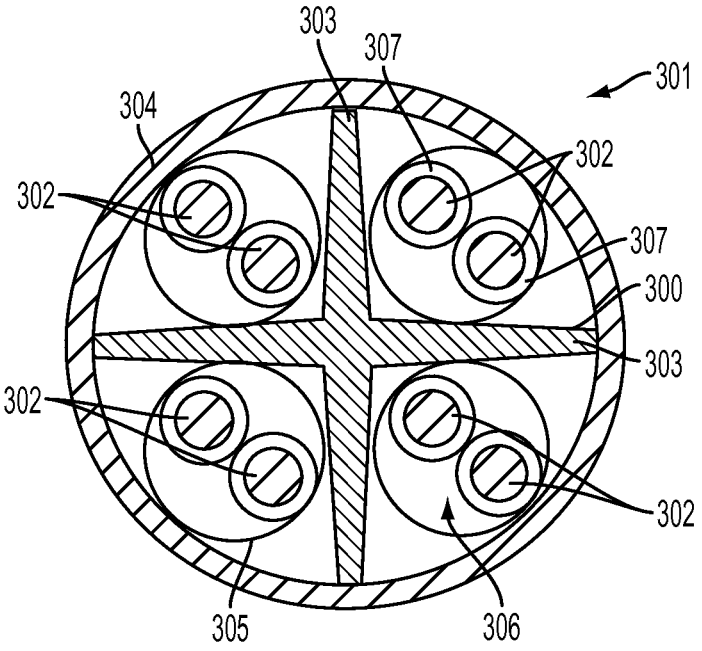
FIG. 3 depicts a cross-sectional end view of the cable including a tapered cross web cable separator according to one embodiment.

As noted above, cable separators can be preshaped to have desired configurations and sizes. For example, as illustrated in FIG. 3, the cable separator 300 used in the cable 301 can be relatively larger in cross section than the similarly shaped cable separator 100, and can have projections 303 that extend outwardly in length to effectively touch the inner surface the cable jacket 304. Such resizing of the cable separator 300 can provide improved separation of the conductors 302, including each of the respective twisted conductor pairs 306. In certain embodiments, these twisted conductor pairs 306 can be further shielded by a shield layer 305. As shown in FIG. 3, each of the individual conductors 302 can have an insulation layer 307.

As can be appreciated, any of the cable separators shown in FIGS. 2-9 can be manufactured in various relative sizes compared to the size of the cable itself. Additionally, in certain embodiments, only certain elements, such as, for example, the projections can vary in size with other elements remaining similarly sized.

According to certain embodiments, the central portion of the separator 100, excluding the projections 103, can be about 0.025 inch to about 0.035 inch in width and the separator as a whole can be about 0.14 inch to about 0.25 inch in width and height. However, as can be appreciated, the dimensions of a cable separator can vary depending on the number of conductors, the gauge of the conductors, and the overall gauge of the cable the separator is intended for use within.

Figure 4:
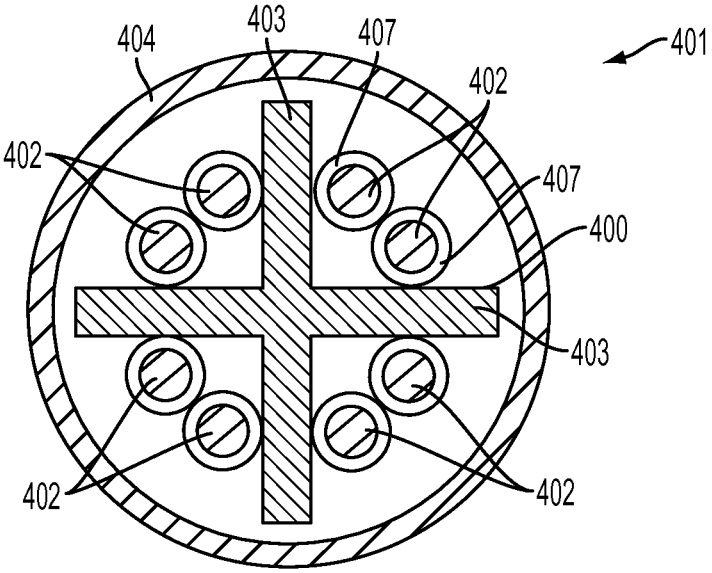
FIG. 4 depicts a cross-sectional end view of the cable including a straight-sided cable separator according to one embodiment.

Cable separators can also have a variety of alternative cross-sectional shapes to the cross-web illustrated in FIGS. 1-3. For example, in FIG. 4, the cable separator 400 in cable 401 can be a straight-sided and can have flat projections 403 instead of tapered projections. These flat projections 403 of the cable separator 400 can provide improved separation of the conductors 402. In certain embodiments, the cable separator 400 can substantially extend to effectively touch an outer protective jacket 404. As shown in FIG. 4, each of the individual conductors 402 can have an insulation layer 407.

Figure 5:
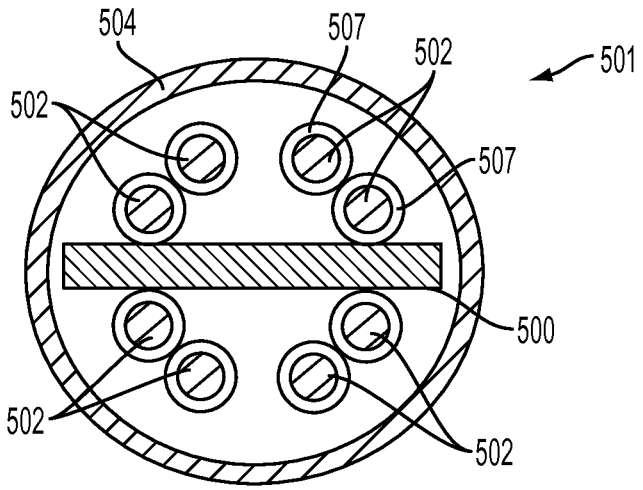
FIG. 5 depicts a cross-sectional end view of the cable including a tape cable separator according to one embodiment.

In FIG. 5, the cable separator 500 in cable 501 can have a tape configuration and can have a substantially flat body without discrete projections. The conductors 502 can be generally separated by the cable separator 500 as shown in FIG. 5 providing improved separation of the conductors 502. In certain embodiments, the cable separator 500 can substantially extend to an outer protective jacket 504. As shown in FIG. 5, each of the individual conductors 502 can have an insulation layer 507. In other embodiments, the cable separator 500 can be tapered and can contain a thicker central portion with narrowing end portions.

Figure 6:
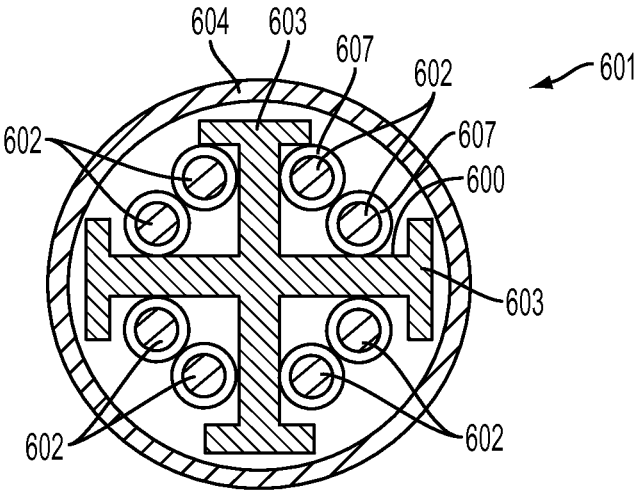
FIG. 6 depicts a cross-sectional end view of the cable including a T-top cable separator according to one embodiment.

Cable separators can also have other, different cross-sectional shapes. For example, in FIG. 6, the cable separator 600 in cable 601 can have a T-top configuration such that each projection 603 includes a T-shaped arrangement. Such a T-shaped arrangement for the projections 603 can be used to further space apart, or secure, the conductors 602 in the cable 601. Thus, the cable separator 600 can provide improved separation of the conductors 602. In certain embodiments, the cable separator 600 can substantially extend to effectively touch an outer protective jacket 604. As shown in FIG. 6, each of the individual conductors 602 can have an insulation layer 607.

Figure 7:
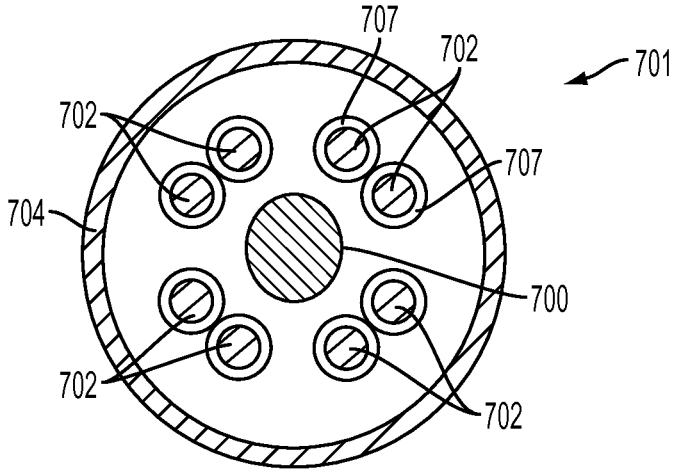
FIG. 7 depicts a cross-sectional end view of the cable including a circular filler cable separator according to one embodiment.

In FIG. 7, the cable separator 700 in cable 701 can have a circular configuration without projections. Such a separator 700 can still provide separation among the conductors 702 by compressing the conductors 702 against the outer protective jacket 704. Thus, the cable separator 700 can provide improved separation of the conductors 702. As shown in FIG. 7, each of the individual conductors 702 can have an insulation layer 707.

Figure 8:
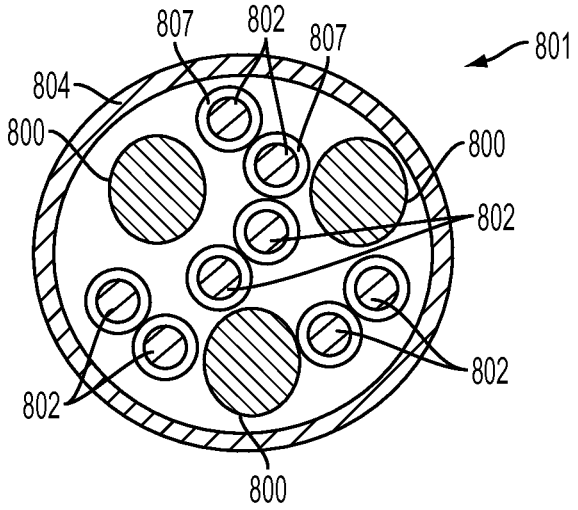
FIG. 8 depicts a cross-sectional end view of the cable including multiple circular filler cable separators according to one embodiment.

As depicted in FIG. 8, multiple circular separators 800 can also be used in a single cable 801 according to certain embodiments. The cable separator 800 can provide improved separation of the conductors 802, including compressing at least some of the conductors 802 against the outer protective jacket 804. As shown in FIG. 8, each of the individual conductors 802 can have an insulation layer 807. As will be appreciated, circular cable separators can be formed as a substantially solid article (as generally shown in FIGS. 7 and 8) or can be hollow. As will also be appreciated, a single cable can also, in certain embodiments, include multiple cable separators with alternative cross-sectional shapes such as, for example, cross-web shapes.

According to certain embodiments, a polycarbonate-based material can be used to form a body of a cable separator. Such polycarbonate-based materials can include any of a variety of suitable polycarbonate-based compositions. Generally, suitable polycarbonate-based compositions can include repeating structural carbonate units of the formula (1):

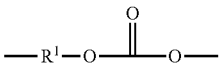

(1)

wherein about 60 percent or more of $R^1$ can be aromatic organic radicals and the balance thereof can be aliphatic, alicyclic, or aromatic radicals. In one embodiment, each $R^1$ can be an aromatic organic radical, such as, for example a radical of the formula (2):

$$-A^1-Y^1-A^1 \quad (2)$$

in which each of $A^1$ and $A^2$ can be a monocyclic divalent aryl radical and $Y^1$ can be a bridging radical having one or two atoms that separate $A^1$ from $A^2$.

In certain embodiments, one atom can separate $A^1$ from $A^2$. Illustrative, non-limiting, examples of such radicals can include —O—, —S—, S(O)—, —S($O_2$)—, —C(O)—, methylene, cyclohexyl-methylene, 2-[2.2.1]-bicycloheptylidene, ethylidene, isopropylidene, neopentylidene, cyclohexylidene, cyclopentadecylidene, cyclododecylidene, and adamantylidene. The bridging radical $Y^1$ can also be a hydrocarbon group or a saturated hydrocarbon group such as methylene, cyclohexylidene, or isopropylidene.

Polycarbonates compositions can also be produced using dihydroxy compounds having the formula HO—$R^1$—OH, including the dihydroxy compounds of formula (3):

$$HO\text{-}A^1\text{-}Y^1\text{-}A^2\text{-}OH \quad (3)$$

wherein $Y^1$, $A^1$, and $A^2$ are as described above. Example dihydroxy compounds can include bisphenol compounds of general formula (4):

(4)

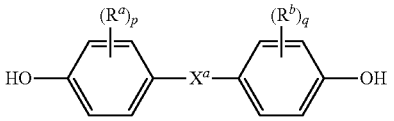

wherein $R^a$ and $R^b$ can each represent a halogen atom or can represent a monovalent hydrocarbon group and wherein $R^a$ and $R^b$ can be the same or different; and p and q are each independently integers of 0 to 4. $X^a$ can represent one of the groups of formula (5):

(5)

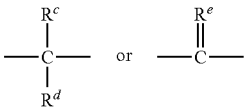

wherein $R^c$ and $R^d$ can each independently represent a hydrogen atom or a monovalent linear or cyclic hydrocarbon group. $R^e$ can be a divalent hydrocarbon group.

Non-limiting examples of dihydroxy compounds can include: resorcinol, 4-bromoresorcinol, hydroquinone, 4,4'-dihydroxybiphenyl, 1,6-dihydroxynaphthalene, 2,6-dihydroxynaphthalene, bis(4-hydroxyphenyl)methane, bis(4-hydroxyphenyl)diphenylmethane, bis(4-hydroxyphenyl)-1-naphthylmethane, 1,2-bis(4-hydroxyphenyl)ethane, 1,1-bis(4-hydroxyphenyl)-1-phenylethane, 2-(4-hydroxyphenyl)-2-(3-hydroxyphenyl)propane, bis(4-hydroxyphenyl)phenylmethane, 2,2-bis(4-hydroxy-3-bromophenyl)propane, 1,1-bis(hydroxyphenyl)cyclopentane, 1,1-bis(4-hydroxyphenyl)cyclohexane, 1,1-bis(4-hydroxyphenyl)isobutene, 1,1-bis(4-hydroxyphenyl)cyclododecane, trans-2,3-bis(4-hydroxyphenyl)-2-butene, 2,2-bis(4-hydroxyphenyl)adamantine, (alpha,alpha'-bis(4-hydroxyphenyl)toluene, bis(4-hydroxyphenyl)acetonitrile, 2,2-bis(3-methyl-4-hydroxyphenyl)propane, 2,2-bis(3-ethyl-4-hydroxyphenyl)propane, 2,2-bis(3-n-propyl-4-hydroxyphenyl)propane, 2,2-bis(3-isopropyl-4-hydroxyphenyl)propane, 2,2-bis(3-sec-butyl-4-hydroxyphenyl)propane, 2,2-bis(3-t-butyl-4-hydroxyphenyl)propane, 2,2-bis(3-cyclohexyl-4-hydroxyphenyl)propane, 2,2-bis(3-allyl-4-hydroxyphenyl)propane, 2,2-bis(3-methoxy-4-hydroxyphenyl)propane, 2,2-bis(4-hydroxyphenyl)hexafluoropropane, 1,1-dichloro-2,2-bis(4-hydroxyphenyl)ethylene, 1,1-dibromo-2,2-bis(4-hydroxyphenyl)ethylene, 1,1-dichloro-2,2-bis(5-phenoxy-4-hydroxyphenyl)ethylene, 4,4'-dihydroxybenzophenone, 3,3-bis(4-hydroxyphenyl)-2-butanone, 1,6-bis(4-hydroxyphenyl)-1,6-hexanedione, ethylene glycol bis(4-hydroxyphenyl)ether, bis(4-hydroxyphenyl)ether, bis(4-hydroxyphenyl)sulfide, bis(4-hydroxyphenyl)sulfoxide, bis(4-hydroxyphenyl)sulfone, 9,9-bis(4-hydroxyphenyl)fluorine, 2,7-dihydroxypyrene, 6,6'-dihydroxy-3,3,3',3'-tetramethylspiro(bis)indane ("spirobiindane bisphenol"), 3,3-bis(4-hydroxyphenyl)phthalide, 2,6-dihydroxydibenzo-p-dioxin, 2,6-dihydroxythianthrene, 2,7-dihydroxyphenoxathin, 2,7-dihydroxy-9,10-dimethylphenazine, 3,6-dihydroxydibenzofuran, 3,6-dihydroxydibenzothiophene, 2,7-dihydroxycarbazole, 3,3-bis(4-hydroxyphenyl)phthalimidine, 2-phenyl-3,3-bis-(4-hydroxyphenyl)phthalimidine ("PPPBP"), and the like, as well as combinations comprising at least one of the foregoing dihydroxy compounds.

Other suitable examples of the types of bisphenol compounds that can be represented by formula (3) can include 1,1-bis(4-hydroxyphenyl)methane, 1,1-bis(4-hydroxyphenyl)ethane, 2,2-bis(4-hydroxyphenyl)propane (hereinafter "bisphenol A" or "BPA"), 2,2-bis(4-hydroxyphenyl)butane, 2,2-bis(4-hydroxyphenyl)octane, 1,1-bis(4-hydroxyphenyl)propane, 1,1-bis(4-hydroxyphenyl)n-butane, 2,2-bis(4-hydroxy-1-methylphenyl)propane, 1,1-bis(4-hydroxy-t-butylphenyl)propane, and dimethyl bisphenol cyclohexane (hereinafter "DMBPC"). Combinations comprising at least one of the foregoing dihydroxy compounds can also be used.

According to certain embodiments, branched polycarbonates can also be useful, as well as blends of a linear polycarbonate and a branched polycarbonate. Branched polycarbonates can be prepared by adding a branching agent during polymerization of the polycarbonate. Suitable branching agents include polyfunctional organic compounds containing at least three functional groups selected from hydroxyl, carboxyl, carboxylic anhydride, haloformyl, and mixtures of the foregoing functional groups. Specific examples include trimellitic acid, trimellitic anhydride, trimellitic trichloride, tris-p-hydroxy phenyl ethane, isatin-bisphenol, tris-phenol TC (1,3,5-tris((p-hydroxyphenyl)isopropyl)benzene), tris-phenol PA (4(4(1,1-bis(p-hydroxyphenyl)-ethyl) alpha, alpha-dimethyl benzyl) phenol), 4-chloroformyl phthalic anhydride, trimesic acid, and benzophenone tetracarboxylic acid. The branching agents can be added at a level of about 0.05% to about 2.0% by weight of the polycarbonate composition. All types of polycarbonate end groups can be useful in the polycarbonate-based material provided that such end groups do not significantly affect desired properties of the polycarbonate-based material.

Specific examples of suitable polycarbonate-based material having end groups are the nitrile end capped polycarbonates. A nitrile end capped polycarbonate can be formed by the reaction of a polycarbonate with a cyanophenyl carbonate endcapping group. Suitable endcapping groups can be formed from a cyanophenol of formula (6):

(6)

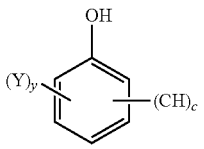

wherein Y is a halogen, $C_{1-3}$ alkyl group, $C_{1-3}$ alkoxy group, $C_{7-12}$ arylalkyl, alkylaryl, or nitro group, y is 0 to 4, and c is 1 to 5, provided that y+c is 1 to 5. In certain embodiments, cyanophenol can be p-cyanophenol, 3,4-dicyanophenol, or a combination comprising at least one of the foregoing phenols. The cyanophenyl endcapping groups can be included in an amount of 1 to 9 cyanophenyl carbonate units per 100 $R^1$ units of formula 1.

In certain embodiments, a nitrile end-capped polycarbonate can be branched with the use of suitable branching agents including, for example, 1,1,1-tris(4-hydroxyphenyl)ethane (THPE), 1,3,5-tris(4-hydroxyphenyl)benzene, tris(4-hydroxyphenyl)methane, 1,1,2-tris(4-hydroxyphenyl)propane, 1,3,5-trihydroxybenzene, m-terphenyltriol, trisphenol PA, 1,3,5-tris((4-hydroxyphenyl)isopropyl)benzene, and 1,1,1-tris(3-methyl-4-hydroxyphenyl)ethane, 1,3,5-trihydroxybenzene, m-terphenyltriol, trimellitic trichloride (TMTC), as well as combinations comprising at least one of the foregoing. In certain embodiments, the branching agent can be trimellitic trichloride (TMTC) or 1,1,1-tris(hydroxyphenyl) ethane (THPE). The amount of branching agent can be dependent upon the desired degree of branching. In certain embodiments, about 1 mol % or less, specifically, about 0.1 mol % to about 0.8 mol % branching agent can be present, based upon a total weight of the branched polycarbonate. In other embodiments, e.g., highly branched, greater than or equal to about 3 mol %, specifically, about 4 mol % or more of branching agent can be present, based upon a total weight of the branched polycarbonate.

As will be appreciated, suitable polycarbonates can be manufactured by processes such as interfacial polymerization and melt polymerization.

In certain embodiments, a polycarbonate-based material can alternatively, or additionally, include a copolymer such as a polysiloxane copolymer or a brominated copolymer. Polycarbonate-polysiloxane copolymer compositions can comprise polycarbonate blocks and polydiorganosiloxane blocks.

The polycarbonate blocks in the polycarbonate-polysiloxane copolymer can include repeating structural units of formula (1). For example, polycarbonate blocks can be derived from reaction of dihydroxy compounds of formula (3) as described above. In some embodiments, the dihydroxy compound can be bisphenol A, in which each of $A^1$ and $A^2$ is p-phenylene and $Y^1$ is isopropylidene. In some embodiments, the dihydroxy compound can alternatively, or additionally, be at least one of PPPBP and DMBPC.

The polydiorganosiloxane blocks of the copolymer can comprise repeating structural units of formula (7) (sometimes referred to herein as siloxane):

(7)

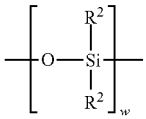

wherein $R^2$ can be a $C_{1-13}$ monovalent organic radical and each occurrence of $R^2$ can be the same monovalent organic radical or a different monovalent organic radical. For example, $R^2$ can be a $C_1$-$C_{13}$ alkyl group, $C_1$-$C_{13}$ alkoxy group, $C_2$-$C_{13}$ alkenyl group, $C_2$-$C_{13}$ alkenyloxy group, $C_3$-$C_6$ cycloalkyl group, $C_3$-$C_6$ cycloalkoxy group, $C_6$-$C_{10}$ aryl group, $C_6$-$C_{10}$ aryloxy group, $C_7$-$C_{13}$ aralkyl group, $C_7$-$C_{13}$ aralkoxy group, $C_7$-$C_{13}$ alkaryl group, or $C_7$-$C_{13}$ alkaryloxy group. Combinations of the foregoing $R^2$ groups can also be used in the same copolymer according to certain embodiments.

The value of w in formula (7) can vary depending on the type and relative amount of each component in the polycarbonate-based material, and the desired properties of the polycarbonate-based material. According to certain embodiments, w can have an average value of about 2 to about 1000, about 2 to about 500, or about 5 to about 100. In some embodiments, w can have an average value of about 10 to about 75, and in other embodiments, w can have an average value of about 40 to about 60.

In certain embodiments, more than one polycarbonate-polysiloxane copolymers can be used. In such embodiments, the average value of w of the first polycarbonate-polysiloxane copolymer can be less than the average value of w of the second polycarbonate-polysiloxane copolymer.

In certain embodiments, the polydiorganosiloxane blocks can also be provided by repeating structural units of formula (8):

(8)

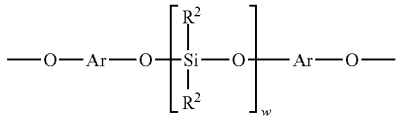

wherein w, and $R^2$ can be selected similarly to like values formula (7), Ar can be a substituted, or unsubstituted $C_6$-$C_{30}$ arylene radical groups, each Ar can be the same or different, and wherein bonds can be directly connected to the aromatic moiety of each Ar. Suitable Ar groups in formula (8) can be derived from a $C_6$-$C_{30}$ dihydroxyarylene compound, such as, for example, dihydroxyarylene compound of formulas (3) or (4) above. Combinations comprising at least one of the foregoing dihydroxyarylene compounds can also be used. Specific examples of suitable dihydroxyarlyene compounds can include: 1,1-bis(4-hydroxyphenyl)methane, 1,1-bis(4-hydroxyphenyl)ethane, 2,2-bis(4-hydroxyphenyl)propane, 2,2-bis(4-hydroxyphenyl)butane, 2,2-bis(4-hydroxyphenyl) octane, 1,1-bis(4-hydroxyphenyl)propane, 1,1-bis(4-hydroxyphenyl)n-butane, 2,2-bis(4-hydroxy-1-methylphenyl) propane, 1,1-bis(4-hydroxyphenyl)cyclohexane, bis(4-hydroxyphenyl sulphide), and 1,1-bis(4-hydroxy-t-butylphenyl) propane. Combinations comprising at least one of the foregoing dihydroxy compounds can also be used.

According to other embodiments, the polydiorganosiloxane blocks can also be derived from the corresponding dihydroxy compounds of formula (9):

(9)

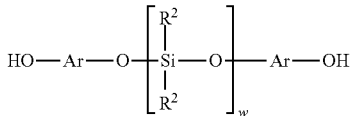

wherein $R^2$, Ar and w can be selected as described above with respect to formula (8). The corresponding dihydroxy compounds of formula (8) are further described in U.S. Pat. No. 4,746,701 to Kress et al., hereby incorporated by reference. Compounds of this formula can be obtained by the reaction of a dihydroxyarylene compound with, for example, an alpha, omega-bisacetoxypolydiorangonosiloxane under phase transfer conditions.

In another embodiment, the polydiorganosiloxane blocks can also, or alternatively, comprise repeating structural units of formula (10):

(10)

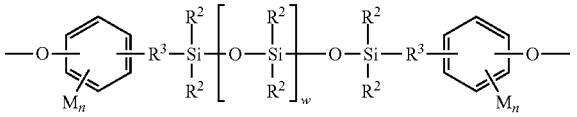

wherein $R^2$ and w are selected as previously discussed. $R^3$ in formula (10) can be a divalent $C_2$-$C_8$ aliphatic group. In some embodiments, each M in formula (10) can be the same or different, and can be a halogen, cyano, nitro, $C_1$-$C_8$ alkylthio, $C_1$-$C_8$ alkyl, $C_1$-$C_8$ alkoxy, $C_2$-$C_8$ alkenyl, $C_2$-$C_8$ alkenyloxy group, $C_3$-$C_8$ cycloalkyl, $C_3$-$C_8$ cycloalkoxy, $C_6$-$C_{10}$ aryl, $C_6$-$C_{10}$ aryloxy, $C_7$-$C_{12}$ aralkyl, $C_7$-$C_{12}$ aralkoxy, $C_7$-$C_{12}$ alkaryl, or $C_7$-$C_{12}$ alkaryloxy, wherein each n is independently 0, 1, 2, 3, or 4.

In one embodiment, M can be a bromo group, a chloro group, an alkyl group such as methyl, ethyl, or propyl, an alkoxy group such as methoxy, ethoxy, or propoxy, or an aryl group such as phenyl, chlorophenyl, or tolyl; $R^3$ can be a dimethylene, trimethylene or tetramethylene group; and $R^2$ is a $C_{1-8}$ alkyl, haloalkyl such as trifluoropropyl, cyanoalkyl, or aryl such as phenyl, chlorophenyl or tolyl. In certain embodiments, $R^2$ can be a methyl, or can be a mixture of methyl and trifluoropropyl, or can be a mixture of methyl and phenyl. In certain embodiments, M is methoxy, n is one, $R^3$ is a divalent $C_1$-$C_3$ aliphatic group, and $R^2$ is methyl.

In certain embodiments, the polydiorganosiloxane blocks of formula (10) can also be derived from the corresponding dihydroxy polydiorganosiloxane (11):

(11)

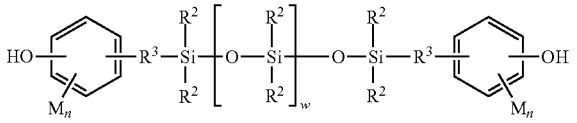

wherein $R^2$, w, M, $R^3$, and n are as described above.

The amount of dihydroxy polydiorganosiloxane in a polycarbonate-polysiloxane copolymer can vary widely to provide the desired amount of polydiorganosiloxane units in the copolymer. For example, a copolymer can be about 1% to about 99% by weight polydimethylsiloxane, or an equivalent molar amount of another polydiorganosiloxane, with the balance being carbonate units. The particular amounts of such polydiorganosiloxanes can vary depending on the desired physical properties of the polycarbonate-based material, the value of D (within the range of 2 to about 1000), and the type and relative amount of each component in the polycarbonate-based material, including, for example, the type and amount of polycarbonate, the type and amount of any included impact modifier, the type and amount of polycarbonate-polysiloxane copolymer, and the type and amount of any other additives. Suitable amounts of dihydroxy polydiorganosiloxane can be determined by one of ordinary skill in the art without undue experimentation. For example, the amount of dihydroxy polydiorganosiloxane can be selected so as to produce a copolymer comprising about 1% to about 75% by weight, or about 1% to about 50% by weight polydimethylsiloxane, or an equivalent molar amount of another polydiorganosiloxane. In certain embodiments, the copolymer can be about 5% to about 40%, by weight, or about 5% to about 25% by weight, of polydimethylsiloxane, or an equivalent molar amount of another polydiorganosiloxane, with the balance being polycarbonate. In a one embodiment, a copolymer can comprise about 20% by weight of a siloxane copolymer.

In certain embodiments the amount of siloxane content in an overall polycarbonate-based composition can be between about 0.5% to about 5% by total weight of the polycarbonate-based composition.

In certain embodiments, the polycarbonate-based material can be a brominated polycarbonate and can be derived from brominated dihydric phenols and carbonate precursors. Alternatively, the brominated polycarbonate can be derived from a carbonate precursor and a mixture of brominated and non-brominated aromatic dihydric phenols. Examples of suitable brominated dihydric phenols can include 2,2-bis(3,5-dibromo-4-hydroxyphenyl)propane and 2,2', 6,6'-tetramethyl-3,3',5,5'-tetrabromo-4,4'-biphenol. Non-limiting examples of non-brominated dihydric phenols for mixing with brominated dihydric phenols to produce brominated polycarbonates can include, for example, 2,2-bis(4-hydroxyphenyl)propane, bis(4-hydroxyphenyl)methane, 2,2-bis(4-hydroxy-3-methylphenyl)propane, 4,4-bis(4-hydroxyphenyl)heptane, and (3,3'-dichloro-4,4'-dihydroxydiphenyl)methane. Mixtures of two or more different brominated and non-brominated dihydric phenols can be used. In certain embodiments, branched brominated polycarbonates can also be used, as can blends of a linear brominated polycarbonate and a branched brominated polycarbonate. Further details of certain flame retardant brominated polycarbonates are disclosed in U.S. Pat. Nos. 3,929,908; 4,170,711; and 4,923,933 each of which is hereby incorporated by reference.

Brominated polycarbonates can act as flame retardants and can be thermoplastic polymers with a high molecular weight. For example, certain brominated polycarbonates can have a weight average molecular weight (Mw) of 8,000 to more than 200,000 atomic mass units ("AMU"), with certain embodiments ranging from 20,000 to 80,000 AMU. In certain examples, the brominated polycarbonates can have an intrinsic viscosity of 0.40 to 1.0 deciliters per gram (dl/g) as measured in methylene chloride at 25° C. In certain embodiments, bromine can constitute about 1% to about 50% by weight of the brominated polycarbonate, in certain embodiments, about 10% to about 30% by weight of the brominated polycarbonate, and in certain embodiments about 20% to about 28% by weight, of the brominated polycarbonate.

According to certain embodiments, a polycarbonate copolymer can also be formed with a polyester copolymer. For example, aromatic polyesters including poly(isophthalate-terephthalate-resorcinol) ester, poly(isophthalate-terephthalate-bisphenol A) ester, and poly[(isophthalate-terephthalate-resorcinol) ester-co-(isophthalate-terephthalate-bisphenol A)]ester can be useful in the copolymerization of polycarbonate. A suitable polycarbonate-polyester copolymer is isophthalic acid-terephthalic acid-resorcinol)-bisphenol A copolyestercarbonate copolymer. As will be appreciated, such polyester copolymers can also be useful in polycarbonate-siloxane copolymers. A suitable example of such a copolymer is poly(bisphenol-A carbonate)-co-poly(isophthalate-terephthalate-resorcinol ester)-co-poly(siloxane) copolymer.

Further examples of suitable polycarbonate-based materials, including polycarbonate resins, polycarbonate homopolymers, and copolymers are described in U.S. Pat. No. 7,858,680 and U.S. Patent Application Publication Nos. 2008/0015289, 2013/0224461 and 2013/0313493 which are hereby incorporated by reference.

In certain embodiments, the polycarbonate-based material can alternatively, or additionally, comprise a commercially obtained polycarbonate composition. Suitable commercial polycarbonate-materials can include, for example, polycarbonates from Lexan™ FST, Lexan™ EXL, Lexan™ XHT, Lexan™ CFR, and Lexan™ SLX polymer lines, each produced by Sabic Innovative Plastics of Pittsfield, Mass.

It should be appreciated that both halogenated, and halogen-free, polycarbonate materials can be selected according to certain embodiments. For example, in certain embodiments a brominated copolymer can be selected while in other embodiments, the polycarbonate composition can be substantially halogen-free. Substantially halogen-free can mean that the polycarbonate composition includes less than about 900 parts per million ("ppm") chlorine, less than about 900 ppm bromine, or less than about 1500 ppm total halogens.

Foaming of a polycarbonate-based material can occur through any suitable foaming process such as, for example though direct gas injection or through chemical foaming. Both processes can work through the addition of a blowing agent to the polycarbonate-based material. Examples of suitable blowing agents can include inorganic agents, organic agents, and chemical agents. Examples of inorganic blowing agents can include carbon dioxide, nitrogen, argon, water, air nitrogen, and helium. Such inorganic blowing agents can, be useful, for example, in direct gas injection techniques. Examples of organic blowing agents can include aliphatic hydrocarbons having 1-9 carbon atoms, aliphatic alcohols having 1-3 carbon atoms, and fully and partially halogenated aliphatic hydrocarbons having 14 carbon atoms. Exemplary aliphatic hydrocarbons that can be used include methane, ethane, propane, n-butane, isobutane, n-pentane, isopentane, neopentane, and the like. Exemplary aliphatic alcohols can include methanol, ethanol, n-propanol, and isopropanol.

According to certain embodiments, fully and partially halogenated aliphatic hydrocarbons can also be used as blowing agents and can include fluorocarbons, chlorocarbons, and chlorofluorocarbons. Examples of suitable fluorocarbons can include methyl fluoride, perfluoromethane, ethyl fluoride, 1,1-difluoroethane (HFC-152a), 1,1,1-trifluoroethane (HFC-143a), 1,1,1,2-tetrafluoroethane (HFC-134a), pentafluoroethane, difluoromethane, perfluoroethane, 2,2-difluoropropane, 1,1,1-trifluoropropane, perfluoropropane, dichloropropane, difluoropropane, perfluorobutane, perfluodichloropropane, difluoropropane, perfluorobutane, perfluorocyclobutane. Partially halogenated chlorocarbons and chlorofluorocarbons can include methyl chloride, methylene chloride, ethyl chloride, 1,1,1-trichloroethane, 1,1-dichloro-1-fluoroethane (HFC-141b), 1-chloro-1,1-difluoroethane (HCFC-142), chlorodifluoromethane (HCFC-22), 1,1-dichloro-2,2,2-trifluoroethane (HCFC-123) and 1-chloro-1,2,2,2-tetrafluoroethane (HCFC-124). Fully halogenated chlorofluorocarbons include trichloromonofluoromethane (CFC-11), dichlorodifluoromethane (CFC-12), trichlorotrifluoroethane (CFC-113), 1,1,1-trifluoroethane, pentafluoroethane, dichlorotetrafluoroethane (CFC-114), chloroheptafluoropropane, and dichlorhexafluoropropane.

It can be appreciated that a blowing agent can be halogenated or substantially halogen-free in certain embodiments. Examples of some halogen-free chemical blowing agents can include azodicarbonaminde, azodiisobutyronitrile, benzenesulfonhydrazide, 4,4-oxybenzene sulfonylsemicarbazide, p-toluene sulfonyl semicarbazide, barium azodicarboxylate, N,N'-dimethyl-N,N'-dinitrosoterephthalamide, trihydrazino triazine and 5-phenyl-3,6-dihydro-1,3,4-oxadiazine-2-one. As can be appreciated, blowing agents can be used in various states including as gaseous states, liquid states, and supercritical states.

The foaming of the polycarbonate-based material can produce cable separators with several desirable properties. For example, foaming can reduce the density, and therefore, weight of a cable separator. Additionally, foaming can reduce the dielectric constant of the cable separator to suitable levels even in embodiments where halogenated flame retardants are used. In certain embodiments, the foam rate can be selected, for example, to reduce the dielectric constant of the cable separator to about 2.7 or less when measured at 1 MHz. In certain embodiments, the dielectric constant of a cable separator can be reduced to about 2.5 or less when measured at 1 MHz. In certain embodiments, the dielectric constant of a cable separator can be reduced to about 2.0 or less when measured at 1 MHz. Suitable levels of foaming can include a foam rate of about 10% to about 90% in certain embodiments; in certain embodiments, a foam rate of about 25% to about 75%; and in certain embodiments, a foam rate of about 50%.

According to certain embodiments, a cable separator can further include additives to retard the propagation of smoke or fire. Such additives can include, for example, one or more of a flame retardant or smoke suppressant.

As will be appreciated, a variety of compounds can act as a flame retardant including, for including, for example, a metal sulfonate, a polymeric char former, a halogenated flame retardant, a fire retardant filler, and an anti-drip additive.

In certain embodiments, a suitable metal sulfonate can be selected from salts of $C_2$-$C_{16}$ alkyl sulfonate salts including, potassium perfluorobutane sulfonate ("Rimar salt"), potassium perfluoroctane sulfonate, tetraethylammonium perfluorohexane sulfonate, potassium diphenylsulfone sulfonate and combinations thereof.

In certain embodiments, a polymeric char former can include polyetherimide, polyphenylene oxide, polyetherimide-siloxane copolymer, polyhedral oligomeric silesquioxanes ("POSS"), polycarbosilane and combinations thereof.

According to certain embodiments, the cable separator can be halogenated and can additionally, or alternatively, include brominated polymeric char formers including, for example, brominated polycarbonate.

Halogenated materials can also be used as flame retardants including, for example, halogenated compounds and resins of formula (12):

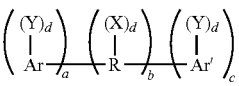

(12)

wherein R is an alkylene, alkylidene or cycloaliphatic linkage, e.g., methylene, ethylene, propylene, isopropylene, isopropylidene, butylene, isobutylene, amylene, cyclohexylene, cyclopentylidene, or the like; or an oxygen ether, carbonyl, amine, or a sulfur containing linkage, e.g., sulfide, sulfoxide, sulfone, or the like. R can also consist of two or more alkylene or alkylidene linkages connected by such groups as aromatic, amino, ether, carbonyl, sulfide, sulfoxide, sulfone, or the like.

Ar and Ar' in formula (12) are each independently mono- or polycarbocyclic aromatic groups such as phenylene, biphenylene, terphenylene, naphthylene, or the like.

Y can be an organic, inorganic, or organometallic radical, for example (1) halogen, e.g., chlorine, bromine, iodine, fluorine or (2) ether groups of the general formula OE, wherein E is a monovalent hydrocarbon radical similar to X or (3) monovalent hydrocarbon groups of the type represented by R or (4) other substituents, e.g., nitro, cyano, and the like, said substituents being essentially inert provided that there is at least one, and optionally two halogen atoms per aryl nucleus.

When present, each X is independently a monovalent hydrocarbon group, for example an alkyl group such as methyl, ethyl, propyl, isopropyl, butyl, decyl, or the like; an aryl groups such as phenyl, naphthyl, biphenyl, xylyl, tolyl, or the like; and aralkyl group such as benzyl, ethylphenyl, or the like; a cycloaliphatic group such as cyclopentyl, cyclohexyl, or the like. The monovalent hydrocarbon group can contain inert substituents.

Each d is independently 1 to a maximum equivalent to the number of replaceable hydrogens substituted on the aromatic rings comprising Ar or Ar'. Each e is independently 0 to a maximum equivalent to the number of replaceable hydrogens on R. Each a, b, and c is independently a whole number, including 0. When b is not 0, neither a nor c can be 0. Otherwise either a or c, but not both, can be 0. Where b is 0, the aromatic groups are joined by a direct carbon-carbon bond.

The hydroxyl and Y substituents on the aromatic groups Ar and Ar' can be varied in the ortho, meta or para positions on the aromatic rings and the groups can be in any possible geometric relationship with respect to one another.

Representative compounds of formula (12) can include bisphenols including: 2,2-bis-(3,5-dichlorophenyl)-propane; bis-(2-chlorophenyl)-methane; bis(2,6-dibromophenyl)-methane; 1,1-bis-(4-iodophenyl)-ethane; 1,2-bis-(2,6-dichlorophenyl)-ethane; 1,1-bis-(2-chloro-4-iodophenyl)ethane; 1,1-bis-(2-chloro-4-methylphenyl)-ethane; 1,1-bis-(3,5-dichlorophenyl)-ethane; 2,2-bis-(3-phenyl-4-bromophenyl)-ethane; 2,6-bis-(4,6-dichloronaphthyl)-propane; 2,2-bis-(2,6-dichlorophenyl)-pentane; 2,2-bis-(3,5-dibromophenyl)-hexane; bis-(4-chlorophenyl)-phenylmethane; bis-(3,5-dichlorophenyl)-cyclohexylmethane; bis-(3-nitro-4-bromophenyl)-methane; bis-(4-hydroxy-2,6-dichloro-3-methoxyphenyl)-methane; and 2,2-bis-(3,5-dichloro-4-hydroxyphenyl)-propane 2,2 bis-(3-bromo-4-hydroxyphenyl)-propane. Other halogenated flame retardants can include: 1,3-dichlorobenzene, 1,4-dibromobenzene, 1,3-dichloro-4-hydroxybenzene, and biphenyls such as 2,2'-dichlorobiphenyl, polybrominated 1,4-diphenoxybenzene, 2,4'-dibromobiphenyl, and 2,4'-dichlorobiphenyl as well as decabromo diphenyl oxide, and the like. Additionally, tetrabromobisphenol A, tetrabromophthalate-diols, dibromostyrene, and tribromophenol can also be included as a halogenated flame retardant in certain embodiments.

Suitable halogenated materials are further described in U.S. Patent Application Publication No. 2009/0306258.

Anti-drip additives can further improve the flame retardant characteristics of a cable separator by decreasing the drip of molten plastic during burning. Suitable anti-drip additives can include polytetrafluoroethylene ("PTFE"), and styrene/acrylonitrile coated PTFE ("TSAN"). TSAN can be produced by copolymerizing styrene and acrylonitrile in the presence of an aqueous dispersion of PTFE. TSAN can include various weight percentages of PTFE and the styrene-acrylonitrile copolymer. For example, TSAN can include about 50% by weight PTFE and about 50% by weight of styrene-acrylonitrile copolymer. The styrene-acrylonitrile copolymer in such a polymerization can individually comprise, about 75% by weight styrene and about 25% by weight acrylonitrile.

In certain embodiments, a fire retardant filler can also be used to further improve the flame retardant characteristics. Suitable fire retardant fillers can include expandable graphite, also known as intumescent flake graphite, and fumed silica. When burned, expandable graphite can retard flame propagation by expanding to lower the bulk density of the material.

In certain embodiments, a smoke suppressant can be an inorganic filler. Suitable inorganic fillers can include, for example, zinc borate, zinc stannate, talc, clay, or a combination of the foregoing. Other suitable smoke suppressants can include molybdenum oxides, such as $MoO_3$, ammonium octamolybdate ("AOM"); calcium and zinc molybdates; iron, copper, manganese, cobalt and vanadyl phthalocyanines; ferrocenes (sometimes referred to as organometallic iron); hydrated iron (III) oxides, hydrates, carbonates and borates; alumina trihydrate (ATH); magnesium hydroxide; non-hydrous and non-ionic metal halides of iron, zinc, titanium, copper, nickel, cobalt, tin, aluminum, antimony and cadmium; nitrogen compounds including ammonium polyphosphates (monammonium phosphate, diammonium phosphate, and the like); and Iron (III) oxide-hydroxides. As will be appreciated, phthalocyanines can be used as a synergist with octabromobiphenyl and the metal halides can be used with complexing agents including quaternary ammonium compounds, quaternary phosphonium compounds, tertiary sulfonium compounds, organic orthosilicates, the partially hydrolyzed derivatives of organic orthosilicates, or a combination thereof. Ferrocenes can be used in combination with Cl paraffin and/or antimony oxide. Such smoke suppressants can be used alone or in combination with other smoke suppressants.

As will be appreciated, certain compounds and additives can function in more than one defined manner and can impart multiple characteristics to the polycarbonate-based materials. For example, certain flame retardant fillers, including polymeric char formers, fire retardant fillers, and anti-drip additives can act as a smoke suppressant in addition to their role as a flame retardant. Likewise, certain smoke suppressants can also beneficially act as a flame retardant and impart such characteristics to the polycarbonate-based material.

In certain embodiments, a cable using the cable separator can pass the National Fire Protection Association ("NFPA") 262 (2011 Edition) and Underwriter's Laboratories ("UL") 910 (1998 Edition) commercial plenum flame test as reported in Table 1. The NFPA 262 test, also called a "Steiner Tunnel Test" uses a chamber that is 25 feet long, 18 inches wide and 12 inches tall. An 11.25 inch wide tray is loaded into the chamber with a single layer of cable and then exposed to a 300,000 btu flame for 20 minutes. A passing result on the NFPA 262 test requires the tested cables to have a flame spread of less than 5 feet, and a maximum peak optical smoke density of 0.50, and an average optical smoke density of 0.15. The NFPA 262 test requires consecutive samples to pass each of these requirements.

The NFPA 262 test results of several Category 6 cables are depicted in Table 1. Inventive Cable 1 includes fluorinated ethylene propylene ("FEP") insulation, a foamed polycarbonate and polysiloxane copolymer separator having a foam rate of about 40%, and a fire-resistant, low smoke, polyvinyl chloride ("PVC") jacket. The polycarbonate and polysiloxane copolymer was Lexan™ EXL 9330 supplied by Sabic Innovative Plastics. Comparative Cables 1 and 2 have similar insulation and jackets as Inventive Cable 1, but include different separators. Comparative Cable 1 includes a foamed FEP separator having a foam rate of about 30% to about 35%. The FEP was Teflon® 9494 supplied by E.I. du Pont de Nemours and Company. Comparative Cable 2 includes a flame retardant polyethylene ("FRPE") separator. The FRPE was Genflam DC 2434 commercially supplied by Gendon Polymer Services Inc. Comparative Cable 2 cannot be foamed because the FRPE exhibits insufficient tensile strength.

TABLE 1

Smoke and Flame Performance

| | Flame spread (in ft.) | Peak Smoke (optical density) | Average Smoke (optical density) |
|---|---|---|---|
| NFPA 262 Requirement | 5 ft. (max.) | 0.5 (max.) | 0.15 (max.) |
| Inventive Cable No. 1 - First Flame Test | 1.5 | 0.33 | 0.10 |
| Inventive Cable No. 1 - Second Flame Test | 1.0 | 0.29 | 0.14 |
| Inventive Cable 1 - NFPA 262 Test Result | Pass | Pass | Pass |
| Comparative Cable 1 - First Flame Test | 1.0 | 0.36 | 0.11 |
| Comparative Cable 1 - Second Flame Test | 1.0 | 0.30 | 0.11 |
| Comparative Cable 1 - NFPA 262 Test Results | Pass | Pass | Pass |
| Comparative Cable 2 - First Flame Test | 3.5 | 0.53 | 0.14 |
| Comparative Cable 2 - Second Flame Test | 2.0 | 0.41 | 0.09 |
| Comparative Cable 2 - NFPA 262 Test Results | Pass | Fail | Pass |

In certain embodiments, the flame spread can be about 5 feet or less as measured using the NFPA 262 test, in certain embodiments about 2.5 feet or less as measured using the NFPA 262 test; and in certain embodiments, the flame spread can be about 2.0 feet or less as measured using the NFPA 262 test. In certain embodiments, the average smoke optical density can be about 0.15 or less as measured using NFPA 262; and in certain embodiments, about 0.12 or less as measured using NFPA 262.

Additionally, in certain embodiments, the cables can also be configured to pass the UL 1666 (2007 Edition) commercial riser test. As can be appreciated by one skilled in the art, cables that satisfy the requirements of the NFPA 262 test are also qualified to pass a variety of less-stringent qualifications/standards associated with UL 1666, UL 1685, and UL 2556-VW-1 and are therefore, suitable for a variety of uses including use as a commercial plenum cable, a commercial riser cable, and as a general purpose cable.

The benefit of using polycarbonate as a cable separator material as opposed to other conventional cable separator materials is demonstrated in Table 2. As depicted in Table 2, polycarbonate exhibits a higher tensile strength and a lower specific gravity than other conventional materials such as FRPE, ethylene chloro-trifluoro-ethylene ("ECTFE"), and FEP. A higher tensile strength indicates that a higher foam rate can be achieved while maintaining structural integrity. As can be appreciated, higher foam rates are beneficial to cable separators as increases to the foam rate can lower dielectric constant values, can reduce the weight of the separator, and can reduce the amount of materials needed. A lower specific gravity also provides for a relatively lighter cable. Table 2 depicts the relative weight basis of each of the materials, in comparison to polycarbonate, as determined by the relationship that Relative Weight=specific gravity*(100−Ideal Foam rate %). As demonstrated by the relative weight basis, polycarbonate offers a significant weight advantage over the other materials.

TABLE 2

| Separator Material | Tensile Strength (MPa) | Specific Gravity | Ideal Foam Rate | Relative Weight (compared to polycarbonate) |
|---|---|---|---|---|
| Polycarbonate and polysiloxane copoylmer (Lexan ™ EXL 9330) | 62 | 1.18 | 40% | 1x |
| FRPE | 8.3 | 1.61 | 0% | 2.3x |
| ECTFE | 54 | 1.68 | 40% | 1.4x |
| FEP | 27 | 2.17 | 30% | 2.1x |

Polycarbonate cable separators can also exhibit several other desirable physical characteristics in certain embodiments. For example, as depicted in Table 3, polycarbonate cable separators can have favorable limiting oxygen index values, tensile strength, and elongation at break values. As can be appreciated, these values can be useful in the production of cables with excellent mechanical and flame-retardant properties.

TABLE 3

| Physical Properties | | | |
|---|---|---|---|
| Separator Material | Limiting Oxygen Index | Tensile Strength | Elongation at Break |
| Polycarbonate Resin | 32% | 9000 psi | 125% |
| Polycarbonate and polysiloxane copolymer | 40% | 7500 psi | 140% |

In certain embodiments, the Limiting Oxygen Index (LOI) can be about 30% or more; and in certain embodiments, the LOI can be about 40% or more.

According to certain embodiments, cables can be constructed by providing a suitable polycarbonate-based material and foaming the polycarbonate-based material. The polycarbonate-material can then be extruded to form a predetermined shape such as a cross-web, tape member, or other separator shape, including configurations described herein. Next, a plurality of conductors can be provided. The separator and conductors can be positioned to separate, or space apart, at least one of the plurality of conductors. In certain embodiments, at least some of the conductors can be provided as twisted pairs instead of individual conductors. Additionally, in certain embodiments, more than one separator can be positioned within the cable. For example, multiple circular separators can be positioned to separate a plurality of conductors. Finally, in certain embodiments, an outer protective jacket can be applied or extruded to surround the separator and plurality of conductors to form the conductive cable.

The dimensions and values disclosed herein are not to be understood as being strictly limited to the exact numerical values recited. Instead, unless otherwise specified, each such dimension is intended to mean both the recited value and a functionally equivalent range surrounding that value.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Every document cited herein, including any cross-referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests, or discloses any such invention. Further, to the extent that any meaning or definition of a term in this document conflicts with any meaning or definition of the same term in a document incorporated by reference, the meaning or definition assigned to that term in the document shall govern.

The foregoing description of embodiments and examples has been presented for purposes of description. It is not intended to be exhaustive or limiting to the forms described. Numerous modifications are possible in light of the above teachings. Some of those modifications have been discussed and others will be understood by those skilled in the art. The embodiments were chosen and described for illustration of various embodiments. The scope is, of course, not limited to the examples or embodiments set forth herein, but can be employed in any number of applications and equivalent articles by those of ordinary skill in the art. Rather it is hereby intended the scope be defined by the claims appended hereto.

What is claimed is:

1. A communication cable comprising:

a cable separator comprising an extruded body extending along the length of the cable, wherein the body is formed from a polycarbonate-based material, wherein the polycarbonate-based material comprises a polycarbonate copolymer, wherein the polycarbonate copolymer comprises polycarbonate-siloxane copolymer, wherein the polycarbonate-based material is at least partially foamed, and wherein the at least partially foamed polycarbonate-based material has a foam rate of about 25% to about 40%.

2. The communication cable of claim 1, wherein the polycarbonate-based material further comprises a polycarbonate resin and at least one of a flame retardant and a smoke suppressant.

3. The communication cable of claim 2, wherein the polycarbonate resin comprises polycarbonate polymer, and wherein the polycarbonate-siloxane copolymer is at least 50% of the total weight of the polycarbonate-based material.

4. The communication cable of claim 1, wherein siloxane in the polycarbonate-siloxane copolymer comprises about 0.5% to about 5% by weight of the polycarbonate-based material.

5. The communication cable of claim 1 is substantially halogen-free.

6. The communication cable of claim 2, wherein the flame retardant is selected from the group consisting of a metal sulfonate, a polymeric char former, a halogenated flame retardant, fire retardant filler, and an anti-drip additive.

7. The communication cable of claim 6, wherein the metal sulfonate is selected from the group consisting of potassium diphenylsulfon-3-sulphonate, potassium-perfluorobutane-sulphonate, and combinations thereof.

8. The communication cable of claim 6, wherein at least one of the anti-drip additive and fire retardant filler is selected from the group consisting of polytetrafluoroethylene and styrene-acrylonitrile treated polytetrafluoroethylene.

9. The communication cable of claim 1, wherein the body includes one or more projections extending in an outward direction.

10. The communication cable of claim 9, wherein the body is a cross-web or is a substantially flat member.

11. The communication cable of claim 1, wherein the cable separator exhibits a Limiting Oxygen Index (LOI) of about 30% or more.

12. The communication cable of claim 1 passes the flame test according to NFPA 262.

13. The communication cable of claim 1 further comprising a plurality of conductors and a jacket layer;

wherein the jacket layer surrounds the plurality of conductors and the separator along the length of the cable.

14. The communication cable of claim 2, wherein the polycarbonate-based material further comprises a polycarbonate polymer and a metal sulfonate.

15. The communication cable of claim 2, wherein the polycarbonate-based material further comprises a polycarbonate polymer and one or more of a halogenated flame retardant and an anti-drip additive.

16. The communication cable of claim 15, wherein the halogenated flame retardant is a brominated polycarbonate and the anti-drip additive comprises a styrene-acrylonitrile treated polytetrafluoroethylene.

17. The communication cable of claim 13, wherein the plurality of conductors comprises one or more pairs of twisted conductors.

* * * * *